US007438614B2

(12) United States Patent
Inaba

(10) Patent No.: US 7,438,614 B2
(45) Date of Patent: Oct. 21, 2008

(54) COOLING SYSTEM FOR OUTBOARD MOTOR

(75) Inventor: Koshiro Inaba, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/524,529

(22) Filed: Sep. 20, 2006

(65) Prior Publication Data

US 2007/0066158 A1 Mar. 22, 2007

(30) Foreign Application Priority Data

Sep. 20, 2005 (JP) ..... 2005-271657

(51) Int. Cl.
*B63H 21/38* (2006.01)

(52) U.S. Cl. ..... 440/88 C; 440/77; 440/88 A

(58) Field of Classification Search ..... 440/77, 440/88 R, 88 A, 88 C
See application file for complete search history.

(56) References Cited

U.S. PATENT DOCUMENTS 3,964,444 A * 6/1976 Hemmann et al. ..... 123/41.49
4,770,262 A 9/1988 Yasunaga et al.
4,927,392 A 5/1990 Makihara et al.
5,078,629 A * 1/1992 Mondek ..... 440/88 R
5,129,847 A 7/1992 Mondek
5,245,954 A 9/1993 Donohue
5,445,547 A * 8/1995 Furukawa ..... 440/77
5,660,571 A * 8/1997 Nakayasu et al. ..... 440/88 R
2001/0027069 A1 10/2001 Mashiko, et al.

FOREIGN PATENT DOCUMENTS

JP 401182192 A * 7/1989
JP 2004-239156 8/2004

OTHER PUBLICATIONS

Translation of JP 401182192A.*

* cited by examiner

*Primary Examiner*—Sherman Basinger
(74) *Attorney, Agent, or Firm*—Knobbe Martens Olson & Bear LLP

(57) ABSTRACT

A boat has an outboard motor mounted to a hull and a remotely mounted cooling air system. The outboard motor has a cowling housing an engine. The cooling air system receives air from within the hull and includes a ventilating fan box. The ventilating fan box may be located within the hull or the cowling of the outboard motor. Cooling air is routed via one or more ducts to the cowling so as to cool the engine while inhibiting moisture from the entering the cowling. The cooling air is preferably blown toward the bottom of the engine.

16 Claims, 3 Drawing Sheets

COOLING SYSTEM FOR OUTBOARD MOTOR

RELATED APPLICATIONS

The present application is based on and claims priority under 35 U.S.C. § 419(a)-(d) to Japanese Patent Application No. 2005-271657, filed on Sep. 20, 2005, the entire contents of which is hereby expressly incorporated by reference herein.

BACKGROUND OF THE INVENTION

1. Field of the Invention

The present invention relates to cooling systems for a boat having an outboard motor and engine.

2. Description of the Related Art

Known outboard motors mix ambient air entering through the engine's cowling with fuel. The air/fuel mixture is burned in one or more cylinders of the motor to generate power and propel the boat. The output efficiency of the engine may decline if the temperature of the engine is not regulated. The air in the cowling must be replaced with fresh air to regulate the temperature of the engine.

U.S. Pat. No. 5,078,629 discloses a structure which inhibits moisture from mixing with the air for combustion. The specification states, "A transom board of the hull has an opening and a cowling of an outboard motor has an air port for taking air for combustion. The opening and the air port are connected to each other through a duct; thereby, air is taken from a location in the hull." "The air hardly contains moisture in comparison with the case in which the cowling of the outboard motor has an intake opening and air is taken through the intake opening." With this structure, combustion air enters through an opening in the transom board. The specification discloses drawing combustion air through the transom, not cooling air.

Patent Document JP-A-2004-239156 discloses a structure that ventilates the cowling of an outboard motor. The specification states, "a boat provided with an outboard motor having a cowling including a bottom cowl with a ventilating air inlet opening downward for introducing outside air, a maze-structure ventilation separator with a zigzag flow path for separating and removing foreign objects, such as moisture, from the outside air, and a ventilating fan combined with a flywheel and essentially made up of fins" (see paragraphs [0092] and [0093], and reference numerals 438 and 439 in FIG. 2). The disclosed structure flows air upwards in the engine compartment. However, the ventilating air inlet is formed through the bottom cowl of the cowling of the outboard motor. Since the outboard motor is placed on water, water may enter through the ventilating air inlet. Further, the structure described in Patent Document JP-A-2004-239156 cannot completely prevent entry of water into the engine compartment when the air contains moisture or small water droplets. Such moisture may deteriorate engine function.

In the cooling system above, moisture from waves may still mix with the air as the air is routed through the engine compartment.

SUMMARY OF THE INVENTION

In view of the foregoing, a need exists for a cooling system that reduces the chance of moisture being introduced into the cowling and causing deterioration of engine function.

An aspect of the invention is directed to a boat that has a hull and an outboard motor. The outboard motor is mounted to the hull and has a cowling. The cowling houses an engine. The boat further includes a duct that is connected to the cowling and that has an inlet and an outlet. The inlet is disposed within the hull and the outlet is disposed within the cowling such that cooling air entering the cowling comes from the hull. The boat further includes a cooling air blower disposed in the cowling and that introduces the cooling air toward the engine.

Another aspect of the invention is directed to a cooling system for an outboard motor that has an engine. The cooling system comprises an enclosure disposed outside of the outboard motor and within a hull of a boat. The cooling system further comprises a first duct that has a first inlet in flow communication with the enclosure and a first outlet in flow communication with the outboard motor. The first duct routes air to the outboard motor such that cooling air for the engine comes from inside the hull. The cooling system further comprises a second duct that has a second inlet in flow communication with the outboard motor and a second outlet in flow communication with the enclosure. The second duct returns the air routed by the first duct to inside the hull.

An addition aspect of the invention is directed to a boat that has a hull and an outboard motor. The outboard motor is mounted to the hull and has a cowling. The cowling houses an engine and an induction system. The boat further includes a first duct that passes through the cowling. The first duct includes a first inlet and a first outlet. The first inlet is disposed within the hull and the first outlet is connected to the induction system such that air ingested by the engine comes from the hull. The boat further includes a second duct connected to the cowling. The second duct has a second inlet and a second outlet. The second inlet is disposed within the hull. The second outlet is disposed within the cowling such that cooling air entering the cowling comes from the hull.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional cooling systems.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely an example and are not intended to limit the invention. The following is a brief description of the drawings.

DETAILED DESCRIPTION OF THE PREFERRED EMBODIMENTS

Figure 1:
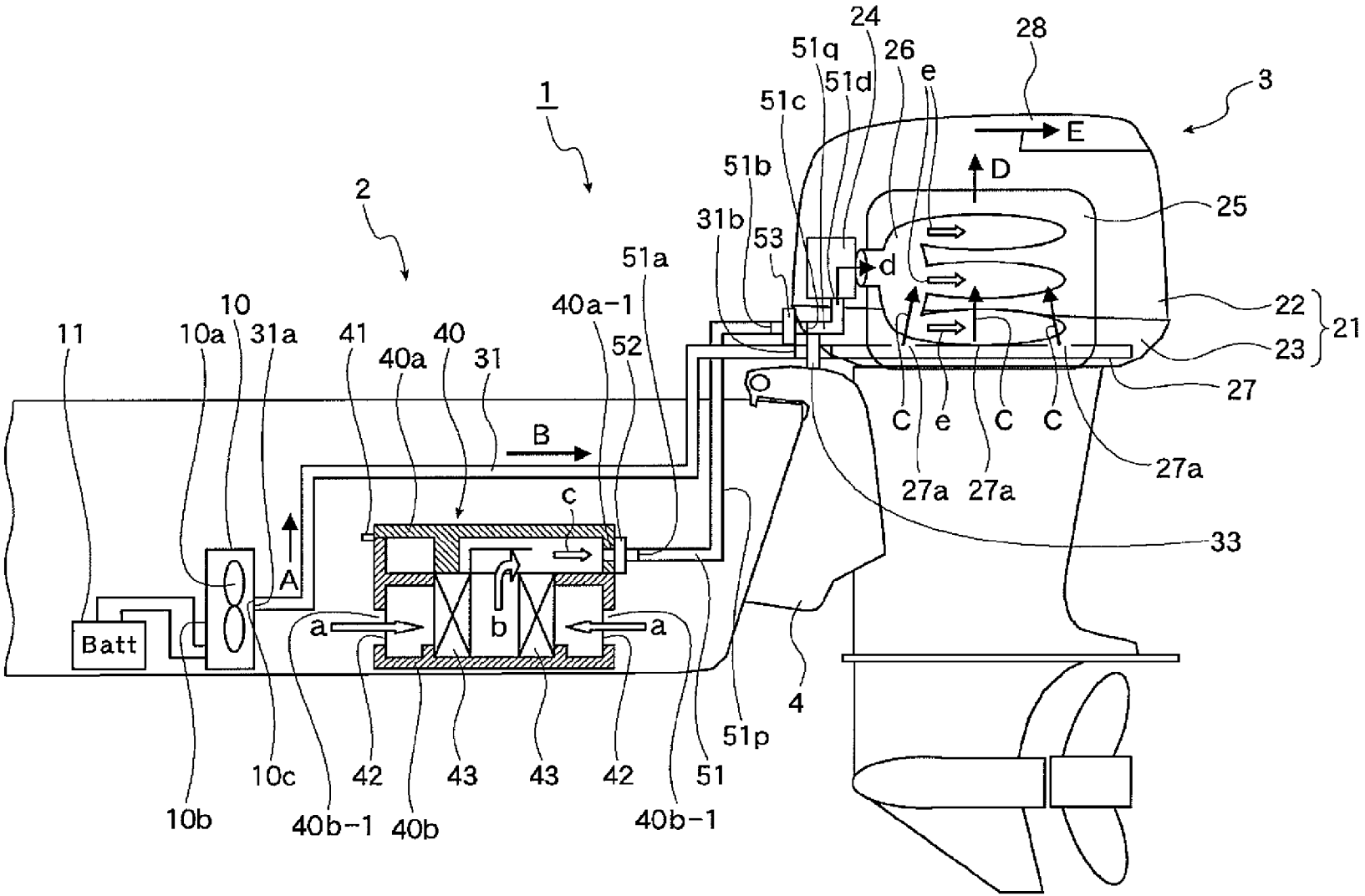
FIG. 1 is a schematic view of a boat having a cooling system configured in accordance with a preferred embodiment of the present invention.

The following detailed description is now directed to certain specific embodiments of the invention. In this description, reference is made to the drawing wherein like parts are designated with like numerals throughout the description and the drawing.

FIG. 1 is a schematic view of a boat 1 having a cooling system configured in accordance with a preferred embodiment of the present invention. The boat 1 includes a hull 2 and an outboard motor 3. The outboard motor 3 is mounted to the hull 2 by a bracket 4 and includes an engine 25. A ventilating air introducing duct 31 is disposed between the hull 2 and the outboard motor 3. In the embodiment illustrated in FIG. 1, one end of the duct 31 is located in the hull 2 and the other end is connected to a cooling air blower 27 of the outboard motor 3. Cooling or ventilating air flows from the hull 2 to the outboard motor 3.

A ventilating fan box or enclosure 10 is disposed in the hull 2 and includes a ventilating fan 10*a*. The ventilating fan 10*a* blows cooling air to the engine 25 and includes a connection part 10*c* which connects to an upstream end of the ventilating air introducing duct 31. Air enters the fan box 10 through an opening face part 10*b*. The entering air is routed to a first connection port 31*a* or "ventilating air inlet." A connection port 31*b* or "first air passage port" connects to an outboard motor side first coupler 33 on the bottom cowl 23.

A battery 11 drives the ventilating fan 10*a*. The battery 11 may be located in the vicinity of the ventilating fan box 10. The ventilating fan 10*a* may be electric and controlled depending on conditions such as the temperature of the engine 25. The ventilating fan 10*a* may continue to operate for a predetermined period of time after the engine 25 has been stopped.

The outboard motor 3 includes a cowling 21. The cowling 21 may include a top cowling member 22 and a bottom cowling member 23. The cowling 21 houses the engine 25 and a fuel introducing device.

A cooling air blower 27 is disposed below the engine 25. In the illustrated embodiment the cooling air blower 27 is a delivery device. However, the device may include a fluid moving device such as a fan or the like. The cooling air blower 27 has one or more air outlets 27*a*. The cooling air blower 27 introduces the air from the ventilating air introducing duct 31 toward the engine 25. The air exiting the air outlets 27*a* preferably flows in a direction toward a lower side of the engine 25. As the air near the bottom of the engine 25 is heated by the engine 25, the air flows towards the top of the engine 25. The heated air is then discharged from the motor 3 through a ventilating air outlet 28 formed on the top interior wall of the top cowl 22.

The outboard motor 3 includes an induction system which routes air to the engine 25 for combustion. The induction system includes a duct 51*p*, 51*q* which routes air from an air intake enclosure 40 disposed inside the hull 2 to the outboard motor 3. The air intake enclosure 40 may include a body 40*b* and a cover or lid 40*a*. Ambient air enters the air intake enclosure 40 through one or more openings 40*b*-1 in and exits through an opening 40*a*-1. The air exiting the opening 40*a*-1 enters the duct via a coupler 52. The duct may be a unitary duct or multiple connected ducts. The duct illustrated in FIG. 1 includes an outer duct section 51*p* connected to an inner duct section 51*q* via an outboard side coupler 53.

The air intake enclosure 40 may include one or more blocking nets 42 and one or more water-repellant filters 43. The nets 42 are preferable disposed in the openings 40*b*-1 and filter foreign substances from the ambient air entering the enclosure 40. The water-repellant filters 43 may be disposed downstream of the nets 42. The filters 43 remove water and moisture from the air by inhibit water or moisture from passing therethrough while allowing air to pass therethrough. Accordingly, foreign substances and/or moisture are inhibited from passing through the enclosure 40 so as to avoid a decrease in engine 25 output caused by foreign substances reaching the engine 25. The water-repellant filters 43 may have a cylindrical and hollow shape.

The lid 40*a* is movable between an open position and a closed position relative to the body 40*b*. A coupling device, such as a hinge 41, couples the body 40*b* and the lid 40*a*. Preferably, the water-repellant filters 43 may be removed and replaced when the lid 40*a* is in the open position.

The inner duct section 51*q* may extend between an outer surface of the cowling 21, for example the bottom cowling member 23, and the engine 25. The outer duct section 51*p* and the inner duct section 51*q* communicate with each other through the outboard side coupler 53. One or both of the inner and outer sections 51*p*, 51*q* may be made of a flexible material so as to allow the outboard motor 3 to move (i.e. pivot, rotate, lift and the like) relative to the hull 2.

The outer duct section 51*p* has a coupling port 51*a* and a coupling port 51*b*. The coupling port 51*a* is disposed at one end of the outer duct section 51*p* and connects to the coupler 52. The coupler 52 may be attached to the lid 40*a* or a surface of the body 40*b*. The coupling port 51*b* is disposed at the other end of the outer duct section 51*p* and connects to a coupler 53. In the illustrated embodiment, the coupler 53 is attached to the bottom cowling 23.

The fuel introducing device either mixes fuel with or delivers fuel into the induction system so as to provide a mixture of air and fuel to the cylinders of the engine 25. In the illustrated embodiment, the air and fuel are mixed within a carburetor 24 before entering an intake manifold 26. The air/fuel mixture is then routed to the combustion chambers of the engine 25.

The fuel introducing device may be, for example, a carburetor, throttle body, one or more fuel injector(s), or other structure that adds fuel to the induction system. For example, the fuel introducing device may be a carburetor 24 as shown in FIG. 1. Alternatively, the fuel introducing device may include one or more fuel injectors to introduce fuel into the induction system, into the engine cylinder(s) or into both. Accordingly, the downstream end of the duct may terminate at the carburetor 24 as illustrated in FIG. 1 or at another location within the induction system depending on the type of induction system employed with the engine 25.

The inner duct section 51*q* has a coupling port 51*c* and a coupling port 51*d*. The coupling port 51*c* is disposed at one end of the of the inner duct section 51*q* and connects to the coupler 53. The coupling port 51*c* provides an opening through the cowling 21. The coupling port 51*d* is disposed at the other end of the inner duct section 51*q*. In the embodiment illustrated in FIG. 1, the coupling port 51*d* connects to the carburetor 24.

The effect of air, which is introduced through the ventilating fan box 10 to cool the engine 25 and circulated in the cowling 21, is next described.

When the engine 25 starts, air enters the front and back of the enclosure 40 through the openings 40*b*-1 in a direction indicated by arrows A. The entering air is filtered of foreign substances by the blocking nets 42. The filtered air flows through the water-repellant filters 43 to remove moisture from the air. The air then continues through the enclosure 40 as indicated by arrow B.

As indicated by arrow C, the filtered, dry air enters the outer duct section 51*p* and flows through the inner duct section 51*q* before entering the carburetor 24. The air passes through the coupling port 51*a* at one end of the outer duct section 51*p*. The outer duct section 51*p* routes the air to the side of the outboard motor 3. The inner duct section 51*q* routes the air entering the cowling 21 to the outboard motor 3. The coupling port 51*d* at the end of the inner duct section 51*q* connects to the carburetor 24.

The carburetor 24 mixes the air with fuel. The air/fuel mixture is introduced into the intake manifold 26 as indicated by the arrow D. The air is further introduced into the combustion chambers, which are not shown, to be burned, as indicated by arrow E. As combustion is repeated, the temperature of the engine 25 begins to rise.

At the same time, when the ventilating fan 10*a* operates, cooling air flows from the ventilating fan box 10 to the connection port 31*a*. The cooling air flows through the ventilating air introducing duct 31 as indicated by an arrow (A) and an arrow (B). Then, the cooling air exits the air outlets 27*a* of the cooling air blower 27 toward a lower side of the engine 25 as indicated by arrows (C). The air having cooled the engine 25 flows to the upper side of the engine 25 as indicated by an arrow (D). The warmed air is discharged through the ventilating air outlet 28 formed at an upper part of the top cowl 22 as indicated by an arrow (E).

The connection port 31*a* is located in the hull 2. The connection port 31*b* is in flow communication with the cooling air blower 27 disposed in the cowling 21. The ventilating air introducing duct 31 extends between the connection port 31*a* and the connection port 31*b*. When the ventilating fan 10*a* is running, the air introduced through the connection port 31*a* is directed to the cooling air blower 27 via the ventilating air introducing duct 31. The cooling air exits the air outlets 27*a* of the cooling air blower 27 toward the engine 25. Since the connection port 31*a* is located in the hull 2, moisture is less likely to be mixed into the air introduced through the connection port 31*a* than if the air intake were disposed outside the hull 2. Therefore, moisture is less likely to reach the engine 25.

Also, the cooling air blower 27 is preferably located below the engine 25. The cooling air blower 27 includes one or more air outlets 27*a*. The air outlets 27*a* preferably open upward toward the engine 25. In this way, the air introduced through the ventilating air introducing duct 31 is blown out through the air outlets 27*a* toward a lower side of the engine 25. The engine 25 is cooled by the air flowing from the lower side to the upper side of the engine 25. Since warmed air rises, the cooling air is preferably blown toward a lower side of the engine 25. As the air warms up and cools the engine 25, the warm air flows in an upward direction which improves the circulation of the cooling air passing by the engine 25. Thus, the cooling efficiency of the engine 25 is improved over system that flow air from the top to the bottom of the engine 25.

In addition, the ventilating fan box 10 is preferably removable from the hull 2. In the illustrated embodiment, the fan box 10 is connected to the connection port 31*a* of the ventilating air introducing duct 31. The air entering through the opening face part 10*b* is routed to the connection port 31*a* through the ventilating fan box 10. Since the ventilating fan box 10 is removable, any location within the hull 2 may be selected for the ventilating fan box 10 and the associated ventilating air introducing duct 31. Since the ventilating fan 10*a* is located in the hull 2 and not in the outboard motor 3, the outboard motor 3 may be smaller in size.

The ventilating air introducing duct 31 is connected to the cowling 21 via the outboard motor side first coupler 33. Therefore, the ventilating air introducing duct 31 can be easily attached to and removed from the cowling 21 of the outboard motor 3.

In addition, the ventilating air introducing duct 31 is connected to the bottom cowl 23 of the cowling 21. Therefore, the ventilating air introducing duct 31 need not be removed when the top cowl 22 is opened for maintenance of the engine 25.

The ventilating fan 10*a* may be continue to operate for a predetermined period of time after stopping the engine 25 which improves the durability of the engine 25.

Figure 2:
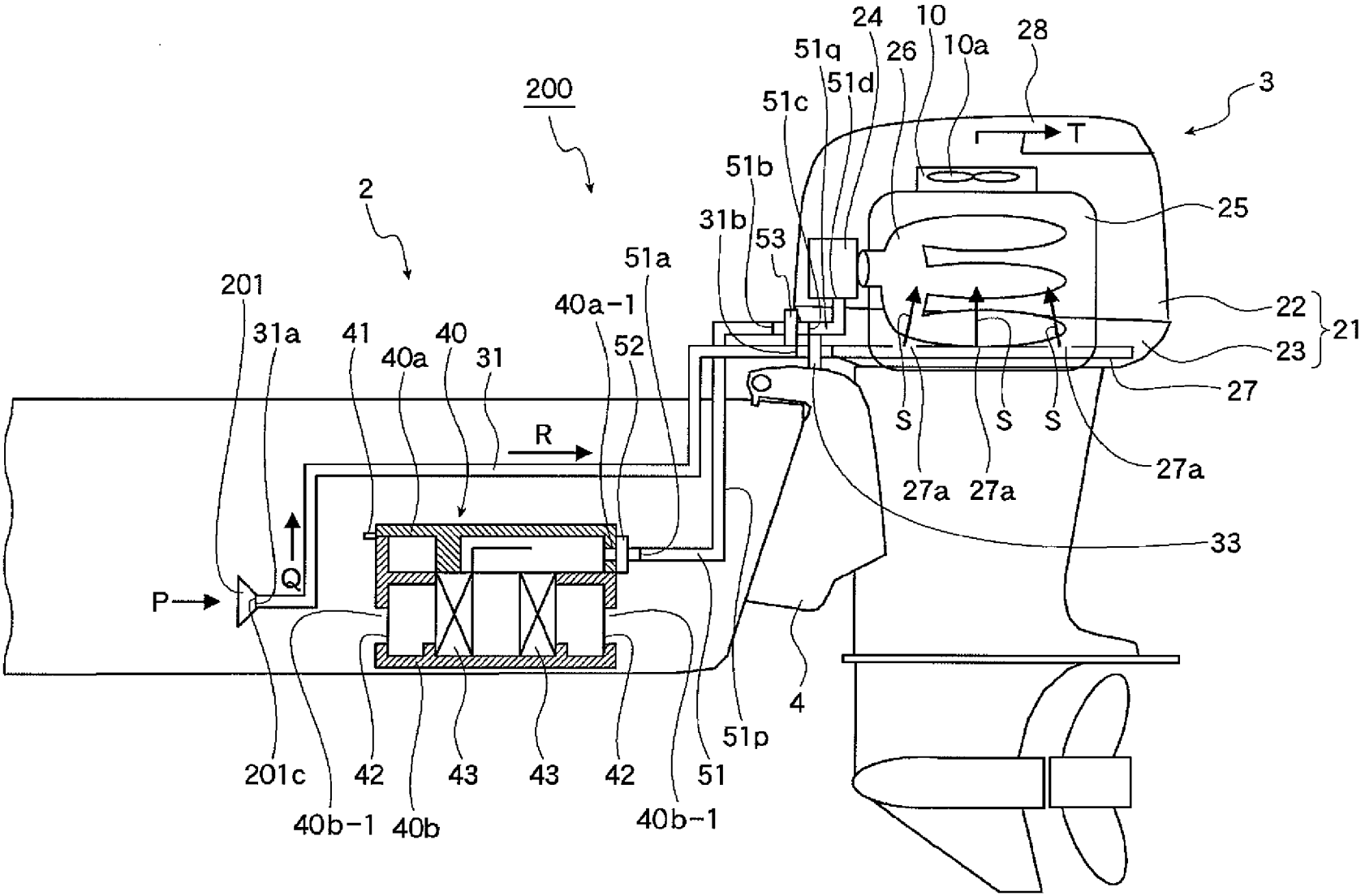
FIG. 2 is a schematic view of a boat having a cooling system configured in accordance with another preferred embodiment of the present invention.

FIG. 2 is a schematic view of a boat having a cooling system configured in accordance with another preferred embodiment of the present invention. The boat 200 illustrated in FIG. 2 is different from the boat 1 illustrated in FIG. 1 in that the boat 200 includes an air intake funnel 201 disposed in the hull 2 and upstream of the ventilating air introducing duct 31. The air intake funnel 201 includes a connection port 201*c* which receives an end of the ventilating air introducing duct 31. The air intake funnel 201 is in flow communication with the connection port 31*a* of the ventilating air introducing duct 31.

The boat 200 illustrated in FIG. 2 is further different from the boat 1 illustrated in FIG. 1 in that the ventilating fan box 10 illustrated in FIG. 1 is located within the cowling 21 of the engine 25 illustrated in FIG. 2. The ventilating fan box 10 houses a ventilating fan 10*a* and is disposed above the engine 25.

The ventilating fan 10*a* can be driven by the engine 25 or other source, for example, an electric motor. In the embodiment illustrated in FIG. 2, the ventilating fan 10*a* is combined with a flywheel and comprises fins integrally attached to the flywheel. Of course other type of fans may be used. For example, the ventilating fan 10*a* may be an electric ventilating fan.

The ventilating fan may be controlled depending on conditions such as the temperature of the engine 25. Other than the differences outlined above, the embodiment of the boat 200 is the same as the embodiment of the boat 1. Accordingly, the description of the boat 1 applies with equal force to the description of the boat 200 and is not hereby repeated.

The manner of cooling the engine 25 in the boat 200 according to the embodiment illustrated in FIG. 2 will now be described. Rotation of the ventilating fan 10*a* draws air through the air intake funnel 201 as indicated by an arrow (P). The air flows through the ventilating air introducing duct 31 as indicated by arrows (Q) and (R) and to the cooling air blower 27. The air exits the cooling air blower 27 through one or more air outlets 27*a* and in a direction toward a lower side of the engine 25 as indicated by arrows (S). The air then flows toward the upper side the engine 25 and is discharged from the outboard motor 3 via a ventilating air outlet 28 as indicated by an arrow (T).

The ventilating fan box 10 is disposed above the engine 25 in the cowling 21. Air driven by the ventilating fan 10*a* exits the outboard motor 3 through the ventilating air outlet 28 in the cowling 21. The ventilating fan 10*a* is preferably disposed in the vicinity of the engine 25. The air warmed by heat leaving from the engine 25 is drawn to the upper side of the engine 25 and discharged through the ventilating air outlet 28.

As the ventilating fan 10*a* dissipates waste heat from the engine 25, the engine 25 temperature can be regulated or decreased so as to keep the engine 25 temperature within a desired range.

Figure 3:
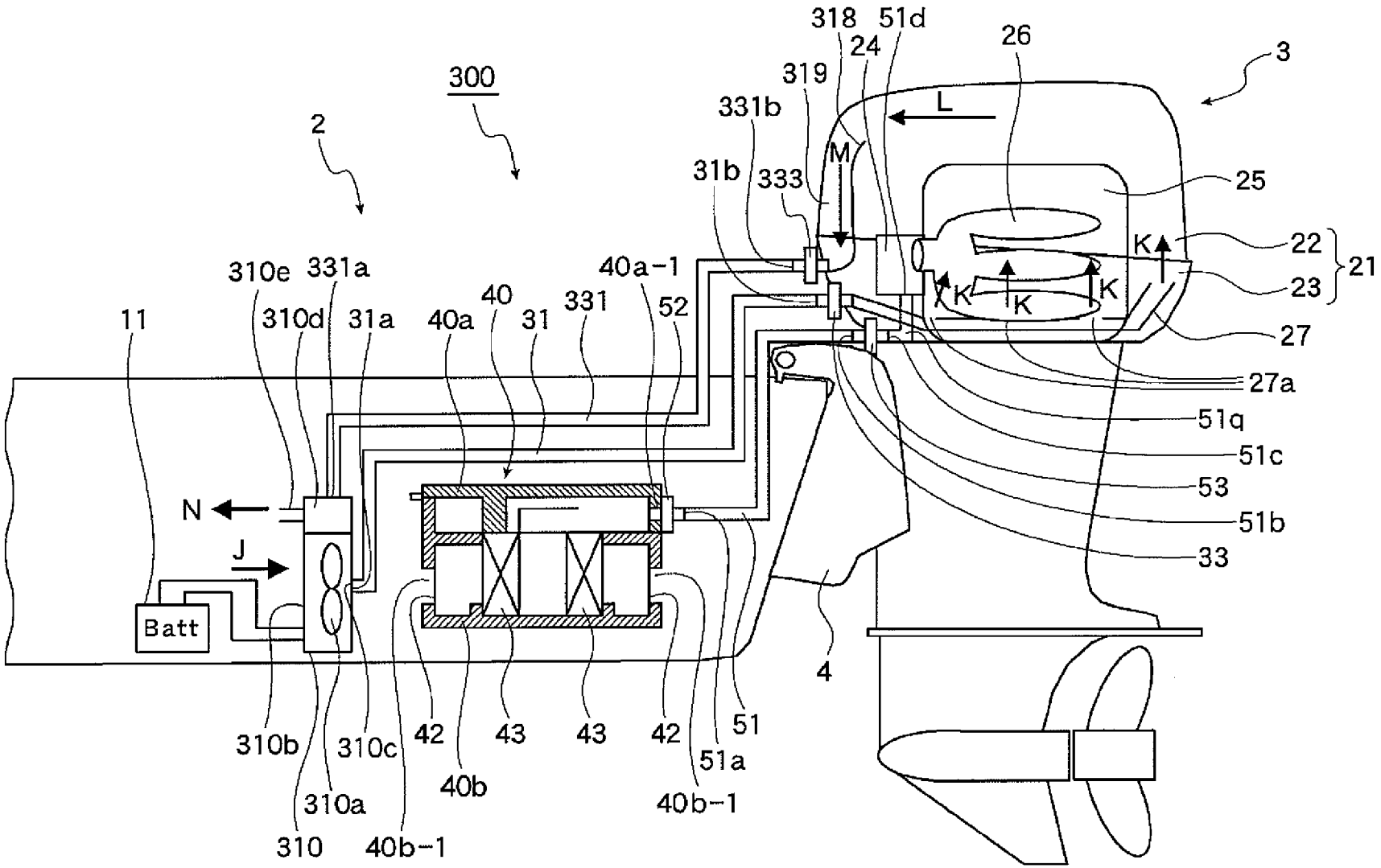
FIG. 3 is a schematic view of a boat having a cooling system configured in accordance with an additional preferred embodiment of the present invention.

FIG. 3 is a schematic view of a boat having a cooling system configured in accordance with an addition preferred embodiment of the present invention. The boat 300 illustrated in FIG. 2 is different from the boat 1 illustrated in FIG. 1 in that the boat 300 includes a ventilating air discharging duct 331. The ventilating air discharge duct 331 routes the air having cooled the engine 25 to the outside environment. The ventilating air discharging duct 331 includes a connection port 331*a* or "ventilating air outlet" located in the hull 2 and a connection port 331*b* located at the outboard motor 3. After cooling the engine 25, the warm air is routed to the connection port 331*b*. Air entering the connection port 331*b* is then routed to the connection port 331*a* and is discharged through an opening 310*e* in a ventilating air discharge part 310*d*.

The boat 300 illustrated in FIG. 3 is further different from the boat 1 illustrated in FIG. 1 in that the cooling system includes a guide 318. The guide 318 guides air to the connection port 331*b*. Other than the differences outlined above, the embodiment of the boat 300 is the same as the embodiment of the boat 1. Accordingly, the description of the boat 1 applies with equal force to the description of the boat 300 and is not hereby repeated.

In the boat 300, the cooing system includes a ventilating fan box 310. The ventilating fan box 310 is preferably located in the hull 2 and includes ventilating fan box body 310*b*, a ventilating fan 310*a*, and a ventilating air discharge part 310*d*. The ventilating fan box body 310*b* includes a connection part 310*c* for receiving an end of the ventilating air introducing duct 31. The ventilating air discharge part 310*d* has an opening 310*e* for exhausted air returning from the outboard motor 3.

The connection port 331*a* is connected to the ventilating air discharge part 310*d*. The connection port 331*b* or "second air passage port" is formed as an "air passage port" at the other end of the ventilating air discharging duct 331. The connection port 331*b* is in flow communication with an outboard motor side third coupler 333. The outboard motor side third coupler 333 is preferably disposed on the bottom cowl 23.

The guide 318 guides the air warmed by the engine 25 to the connection port 331*b*. The guide 318 is preferably disposed on an inner wall of the bottom cowl 23 on the side of the hull 2. The guide 318 preferably extends from a location below an opening of the outboard motor side third coupler 333 and perpendicular to a surface of the bottom cowl 23. The guide 318 may have a curved distal end portion that extends generally parallel to an inner surface of the top cowl 22.

The region between the guide 318 and the cowling 21 forms a ventilating air passage 319. The ventilating air passage 319 is in flow communication with the connection port 331*b*. Even when the top cowl 22 and the bottom cowl 23 are joined together, the warm air located near the top interior wall of the top cowl 22 flows downward toward the ventilating air discharging duct 331.

The manner of cooling the engine 25 in the boat 300 according to the embodiment illustrated in FIG. 3 will now be described. The ventilating fan box 310 draws air in as indicated by an arrow (J) in FIG. 3. The air passes through the ventilating air introducing duct 31 and exits the air outlets 27*a* of the cooling air blower 27 toward a lower side of the engine 25 as indicated by arrows (K). The air flows to the upper side of the engine 25 and along the top interior wall of the top cowl 22 as indicated by an arrow (L). The air passes through the ventilating air passage 319 between the cowling 21 and the guide 318 as indicated by an arrow (M). The air then passes through the ventilating air discharging duct 331 before being discharged through the opening 310*e* of the ventilating air discharge part 310*d* as indicated by an arrow (N).

The ventilating air discharging duct 331 directs the air having cooled the engine 25 to the outside. The connection port 331*a* at one end of the ventilating air discharging duct 331 is located in the hull 2. The ventilating air discharging duct 331 extends to the outboard motor 3. The connection port 331*b* at the other end of the ventilating air discharging duct 331 connects to the cowling 21 of the outboard motor 3. After cooling the engine 25, the warmed air passes through the connection port 331*b* and through the ventilating air discharging duct 331 to the connection port 331*a*. The air is then discharged through the opening 331*e* in the ventilating air discharge part 331*d*.

The embodiment illustrated in FIG. 3 discharges cooling air from the outboard motor 3 in the hull 2. With this embodiment, there is no need for a ventilating air outlet 28 through the cowling 21 as described in connection with the embodiment illustrated in FIG. 2. Without the ventilating air outlet 28, there is less chance that water may enter the outboard motor 3.

The guide 318 is formed in the cowling 21 so that air having passed through the gap between the cowling 21 and the guide 318 is directed to the connection port 331*b*. The air exiting the air outlets 27*a* of the cooling air blower 27 and which is subsequently heated by the engine 25 is discharged through the gap between the cowling 21 and the guide 318. The embodiment illustrated in FIG. 3 provides a specific route for the cooling air through the cowling 21 which may improve the efficiency of the engine 25.

The ventilating air discharging duct 331 is connected to the cowling 21 via the outboard motor side third coupler 333 and can be easily attached to and removed from the cowling 21.

The ventilating air discharging duct 331 is connected to the bottom cowl 23 of the cowling 21. When the cowling 21 comprises a top cowl 22 and a bottom cowl 23, there is no need to remove the ventilating air discharging duct 331 when the top cowl 22 is opened for maintenance of the engine 25.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof.

In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A cooling system for an outboard motor having an engine, the cooling system comprising:

an enclosure disposed outside of the outboard motor and within a hull of a boat;

a first duct having a first inlet in flow communication with the enclosure and a first outlet in flow communication with the outboard motor, the first duct routing air to the outboard motor such that cooling air for the engine comes from inside the hull;

a second duct having a second inlet in flow communication with the outboard motor and a second outlet in flow communication with the enclosure; and a fan configured to propel the air at least from the outboard motor to inside the hull via the second duct.

2. A boat comprising:

a hull;

an outboard motor mounted to the hull and having a cowling, the cowling housing an engine;

a duct connected to the cowling and having an inlet and an outlet, the inlet being disposed within the hull and the outlet being disposed within the cowling such that cooling air entering the cowling comes from the hull;

a cooling air blower disposed in the cowling and introducing the cooling air toward the engine separate from air for combustion in the engine; and a ventilating air discharging duct for routing the cooling air through a wall of the cowling, wherein the ventilating air discharging duct includes an outlet, the outlet being disposed within the hull.

3. The boat according to claim 2, further comprising a ventilating fan driving air between the inlet and the outlet of the duct.

4. The boat according to claim 3 further comprising a ventilating fan box disposed in the hull, the ventilating fan box housing the ventilating fan and being in flow communication with the inlet of the duct.

5. The boat according to claim 4, wherein the ventilating fan box comprises a connection part and an external opening, the connected part being connected to the duct inlet.

6. The boat according to claim 3 further comprising a ventilating fan box housing the ventilating fan, the ventilating fan box being disposed above the engine in the cowling.

7. The boat according to claim 3, wherein the ventilating fan comprises a flywheel.

8. The boat according to claim 3, wherein the ventilating fan comprises fins integrally attached to a flywheel.

9. The boat according to claim 3, wherein the ventilating fan is electric.

10. The boat according to claim 9, wherein the ventilating fan is controlled at least in part based upon a temperature of the engine.

11. The boat according to claim 3, wherein the ventilating fan operates for a predetermined period of time after the engine has stopped.

12. The boat according to claim 2, wherein the cooling air blower is disposed below the engine.

13. The boat according to claim 2, further including a plurality of air outlets disposed within the cowling, the plurality of air outlets routing the cooling air in an upward direction toward the engine.

14. The boat according to claim 2, wherein the ventilating air discharging duct includes an inlet, the inlet being in flow communication with the cowling.

15. The boat according to claim 14 further comprising a guide, the guide being disposed so as to direct the cooling air in the cowling toward the inlet to the ventilating air discharging duct.

16. The boat according to claim 2, wherein the duct connects to a lower portion of the cowling.

* * * * *